US007111813B2

(12) United States Patent
Lin

(10) Patent No.: US 7,111,813 B2
(45) Date of Patent: Sep. 26, 2006

(54) SUPPORT CLIP AND PILASTER APPARATUS AND METHOD

(75) Inventor: Jianhan Lin, Weaverville, NC (US)

(73) Assignee: Thermo Electron Corporation, Waltham, MA (US)

( * ) Notice: Subject to any disclaimer, the term of this patent is extended or adjusted under 35 U.S.C. 154(b) by 0 days.

(21) Appl. No.: 10/126,784

(22) Filed: Apr. 22, 2002

(65) Prior Publication Data

US 2003/0197102 A1 Oct. 23, 2003

(51) Int. Cl.
*A47G 29/02* (2006.01)

(52) U.S. Cl. ..... 248/239; 248/250

(58) Field of Classification Search ..... 248/220.43, 248/239, 250, 222.51, 345.1; 211/119.003, 211/90.01, 90.02, 90.04; 108/107, 108, 109
See application file for complete search history.

(56) References Cited

U.S. PATENT DOCUMENTS 1,702,937 A * 2/1929 Friedemann ..... 248/243
2,674,431 A * 4/1954 Attwood ..... 248/243
2,839,350 A * 6/1958 Hill et al. ..... 312/351
3,081,717 A * 3/1963 Yurevich ..... 108/107
3,895,774 A * 7/1975 Sharp ..... 248/243
D243,440 S * 2/1977 Strinning ..... D8/381
5,351,740 A * 10/1994 Hanna ..... 160/135
5,356,106 A * 10/1994 Trotta et al. ..... 248/243
6,123,303 A * 9/2000 Huang ..... 248/241
6,138,584 A * 10/2000 Waite ..... 108/108
6,189,248 B1 * 2/2001 Nagel et al. ..... 40/661.03
6,341,755 B1 * 1/2002 Kump ..... 248/220.41
6,402,108 B1 * 6/2002 Remmers ..... 248/243

* cited by examiner

*Primary Examiner*—A. Joseph Wujciak, III
(74) *Attorney, Agent, or Firm*—Baker & Hostetler LLP

(57) ABSTRACT

A clip is used with a pilaster assembly, where the clip is snap-fit into the slots of the pilaster, so that the clip is retained when inserted into the slots. This provides the advantage that the clips tend not to fall out due to bumps or vibrations such as those that can occur, for example, during transport of a cabinet having the pilasters and clips.

18 Claims, 3 Drawing Sheets

SUPPORT CLIP AND PILASTER APPARATUS AND METHOD

FIELD OF THE INVENTION

The present invention relates generally to the field of pilaster strips having slots that accept removable clips for the support of various items. More particularly, some embodiments of the invention pertain to clips for supporting shelves or other items that are removably attached to pilaster strips in various cabinets, including for example various cabinet enclosures. More particularly, the invention in some embodiments relates to pilasters having slots that accept fingers that protrude into the slots. Further, some embodiments of the invention pertain to height-adjustable pilaster and clip arrangements.

BACKGROUND OF THE INVENTION

It is known in a wide variety of applications to use a vertical pilaster strip having a plurality of slots in combination with removable clips that have fingers that engage the slots. Pilaster and clip arrangements are well known, for example, for supporting shelves in a cantilevered fashion from a wall, so that the clip forms an extended cantilevered elongated bracket to support the entire shelf. In other situations where the shelf is being suspended on multiple sides, for example, in the case of a box-shaped cabinet, it has been known to use shorter clips that extend horizontally outward a small distance from the pilaster strips, on two or three sides of the shelf to support the shelf.

The pilaster strips are often formed as an elongated U-shaped ban that provides a vertical strip-type surface having slots evenly spaced along its length. The clips typically have two or more fingers spaced with the same spacing as the slots. The fingers can be inserted into the slots, and then slid downwardly by a small distance so that they interlock with the slots and will not pull out from the slots unless the clip is raised again. Once the clip has been slid down into the slots, the clip provides a secure mounting point. Often times, the clip has a top resting surface onto which a shelf or other item can be supported.

The prior art clips have been known to have a completely planar configuration, with a thickness that is slightly less than the width of the slots. This permits the fingers to be inserted into the slots, with some sideways clearance, and then be slid down into the supporting position. The clips then bear the weight of the shelf or other item, and this tends to hold the clips in place once the clips and the shelf or other item have been installed in this way.

Pilaster and clip arrangements are often used in various cabinets such as furniture or other storage cabinets. For example, pilaster and clip arrangements are used in the interior of environmentally controlled cabinets, such as for example refrigerated cabinets.

In some situations, it is desirable to insert the clips into the slots of a pilaster prior to a transport of the cabinet. For example, in the case of refrigerators, it is frequent that the refrigerator will be shipped via air, truck, or railroad, with the pilasters pre-installed on the cabinet, and the clips and shelves placed inside the cabinet. Frequently for transport the shelves may be resting on the clips. In other transport situations, the clips may be simply clipped into the pilasters by themselves so that they can be conveniently transported and located by the user when the refrigerator reaches the destination. In this circumstance the shelves may be resting in the bottom of the cabinet, and are not supported by the clips.

It has been found that in this situation where the clips are merely resting in the pilaster slots, but are not supporting any other weight, the clips, which are themselves relatively light, can be dislodged by vibrations or bumps during transit. That is, vibrations or bumps can cause the clips, which are relatively loosely fit in the slots when they are not supporting any other weight, to bounce or jiggle vertically enough so that they fall out of the slots. This is undesirable, because the clips then fall to the bottom of the enclosure, and may become lost or misplaced or at least had to locate at some point during unpacking at the destination. Also, even if the clips are supporting the shelf, vibration can cause the clips to disengage, and then both the shelf and clips can fall to the bottom of the cabinet, damaging the shelf.

One remedy for this problem has been to add a tie wrap that ties around a part of the clip and around a part of the shelf, e.g. a side rail of a wire-type shelf. The tie wrap can be a conventional plastic tie. However, this adds the inconvenience of a separate component.

In view of the foregoing, it is apparent that it would be desirable to have a system and method for retaining clips such as shelf clips in the pilaster slots so they are retained in place during vibration. It would also be desirable to provide this clip retaining effect without the need for additional parts or pieces, while reducing the expense associated with manufacture of the arrangement, and also while providing an arrangement that is easy to insert and remove.

SUMMARY OF THE INVENTION

The invention in some embodiments provides an apparatus system and method for retaining clips such as shelf clips in pilaster slots. The invention also in some embodiments provides this clip retaining effect without the need for additional parts or pieces, while reducing the expense associated with manufacturer of the arrangement, and also while providing an arrangement that is easy to insert and remove.

In one embodiment, a clip for use with a pilaster includes a body portion; a first finger portion projecting from the body portion and insertable through one of the pilaster slots, and having a first planar portion; and a second finger projecting from the body portion and insertable in another of the pilaster slots, and having a second planar portion at an angle to the first planar portion, so that the first and second planar portions are non-coplanar with each other.

In another embodiment, a system for supporting an item on a wall surface, has a pilaster strip arranged generally along the wall surface and having at least two slots therein. A clip has a body portion, a first finger portion projecting from the body portion and insertable through one of the slots, the first finger having a first planar portion; and a second finger projecting from the body portion and insertable in another of the slots, the second finger having a second planar portion at an angle to the first planar portion so that the first and second planar portions are non-coplanar with each other.

In another embodiment, a method for releasably affixing a clip having two fingers to a pilaster strip is providing a first finger of the clip is inserted into a slot of the strip, so that the first finger extends into the slot, and a second finger is offset from a second slot. A force is applied to flex the clip so that the second finger is inserted into the second slot. The force applied to the clip is released, so that the clip springs into a position where the second finger has a partial interference with the second slot and the first finger has a partial interference with the first slot, thereby retaining the clip in the slot.

Another embodiment is a method of making a clip for a pilaster strip system, including the steps of: forming a clip having a body portion, a first finger portion, and a second finger portion; and bending at least one finger portion to be non-coplanar with the other finger portion.

Still another embodiment provides a clip for use with a pilaster having at least a pair of slots therein. The clip has a body portion; first engaging means projecting from said body portion for engaging one of the slots and having a first planar portion; and second engaging means projecting from the body portion and insertable in another of the slots and having a second planar portion at an angle to the first planar portion so that the first and second planar portions are non-coplanar with each other.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

Figure 3:
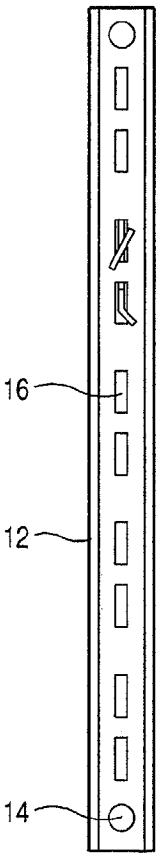
FIG. 3 is a rear view of a pilaster strip having a clip inserted therein.

In general, the present invention provides a clip used with a pilaster assembly, where the clip is snap-fit into the slots of the pilaster, so that the clip is retained when inserted into the slots. This provides the advantage that the clips tend not to fall out due to bumps or vibrations such as those that can occur, for example, during transport of a cabinet.

Turning now to the figures, a system 10 is shown having a pilaster strip 12 that has a plurality of fastening holes 14 that accepts screws that fasten the pilaster strip 12 to a vertical surface, such as an inside wall 15 of a cabinet. The cabinet may be an environmental control unit in the form of a refrigerator or other environmental control unit. The shelf support clips 20 each include a body 21, an upper finger 22 and a lower finger 24. The fingers each have a lower portion 23, 25 that interferes with the pilaster 12 to hold the clips 20 in place when installed. In some embodiments, both of the lower portions 23 or 25 do not need to extend below their slots.

The pilaster strip 12 includes a plurality of somewhat elongated slots 16 that accept fingers 22, 24 of the shelf support clips 20. A notch 26 is provided between the fingers and accepts a tool as discussed in more detail herein. The clips 20 also include an upper surface 28 for supporting an item such as a shelf 30. In the embodiments illustrated, the upper surface 28 includes a upwardly projecting post 29 that engages with a hole 32 on the lower surface of the shelf to further retain the shelf 30 in position.

Figure 6:
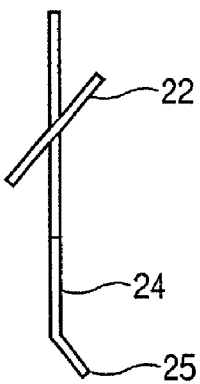
FIG. 6 is a end view of a clip according to FIGS. 5 and 6.

As can be seen particularly in FIGS. 3 and 6, the clip 20 is not completely planar and at least portions of the fingers 22 and 24 are twisted in opposite directions from each other. Due to the opposite twists of the fingers 22 and 24, once the clip is 20 installed, the fingers 22 and 24 interfere with the surface behind the respective slots 16, and are not directly aligned with the slots 16, so therefore the clip 20 tends to be retained in position against the pilaster 12, until removed by the use of a degree of flexing force as described in more detail herein. FIG. 6 in particular shows that the entire upper finger 22 is angled relative to the body 21, and the lower portion 25 of lower finger 24 is angled in an opposite direction. However, either part or all of either or both fingers 22 and 24 may be bent. In the particular embodiment shown with the entire upper finger 22 being planar and angled, there is also shown an upper portion 27. When the clip is inserted as shown in FIG. 3, both the upper portion 27 and lower portion 23 of the finger 22 interfere with the edges of the slot.

Figure 7:
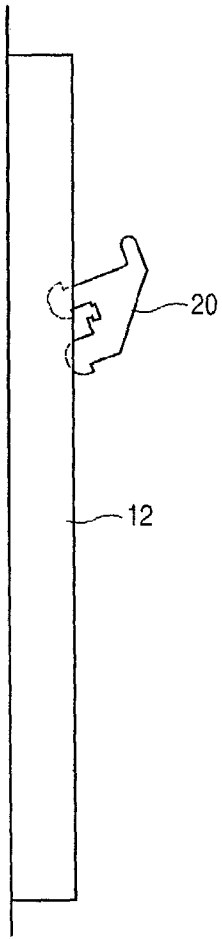
FIG. 7 is a side view of a clip partially inserted in a pilaster.

The method of installation and removal of the clips 20 is generally as follows. First, the user inserts the upper finger 22 into a desired slot 16. Then, the user begins to insert the lower finger 24 as far into the desired slot 16 as possible, as illustrated in FIG. 7.

Due to the twists of the upper finger 22 and lower finger 24, there will often be a resistance to the final insertion of the lower finger 24. That is, the lower finger 24 will tend to just not quite clear the lower slot 16 into which it is placed. At this point, the application of some degree of bending or flexing force on the clip 20 is required to finish the insertion of the lower finger 24.

Figure 5:
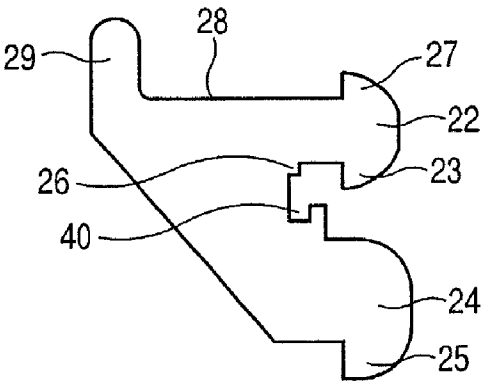
FIG. 5 is a side view of an alternate embodiment of clip according to the present invention.
Figure 4:
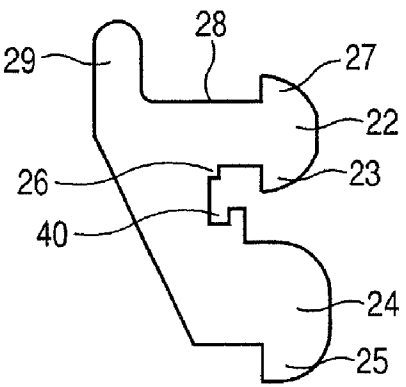
FIG. 4 is a side view of a clip according to the present invention.

Depending on, e.g., the thickness, shape, geometry and material of the chip, as well as the degree of twist present in the FIGS. 22 and 24, and the width of the slots 16, either a very small degree of force or a somewhat larger degree may be required. In many embodiments, the user can by flex the clip by hand and press it inward until the lower finger 24 clears the slot 16 and snaps into place. The lower portions 23 and 25 can be rounded as shown in FIGS. 4 and 5 to assist in a smooth sliding contact between the lower portions 25 during the insertion into the slots.

Figure 8:
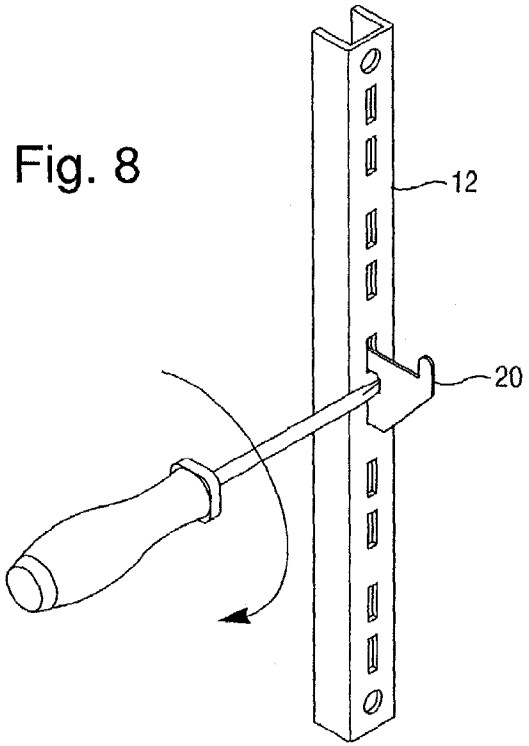
FIG. 8 is a perspective view of a clip being installed in a pilaster.

Should greater force be required, an extra rectangular cut-out 40 is provided in the clip 20 which is sized to accept a tool such as for example, a conventional screw driver. As seen in FIG. 8, the screw driver provides extra leverage to bend to the clip and also can be twisted to urge the lower finger 24 down and inwards until it snaps into place.

Figure 2:
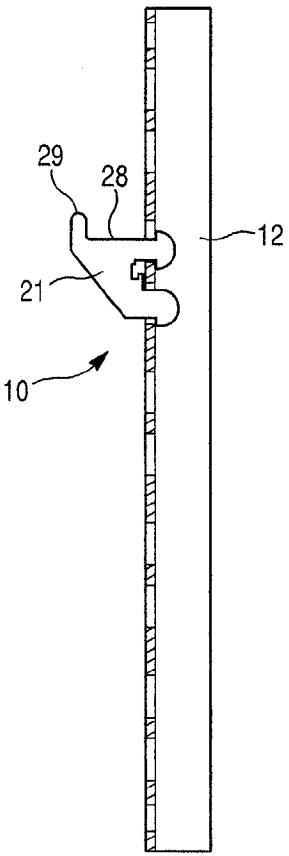
FIG. 2 is a side cross sectional view of a pilaster strip having a clip inserted therein.
Figure 1:
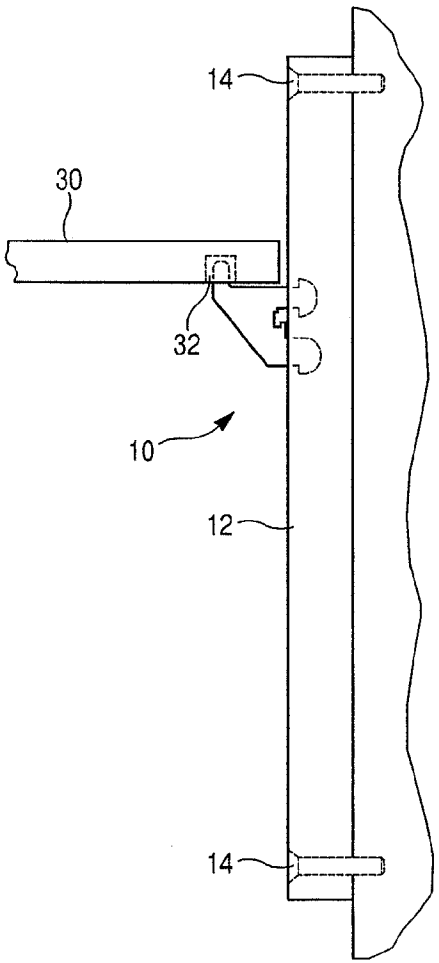
FIG. 1 is a schematic side view of a pilaster strip on a wall having a clip inserted therein for supporting a shelf.

Once the clip 20 is installed, it adopts the configuration shown in FIGS. 1 through 3. Portions 23, 25 and 27 form a stable triangle support plane on the back surface of pilaster 12. Because of this, the clip can be used with slots of varying lengths. There is no need for the portions 23 and 25 to be slid down so they extend past the lower edge of their respective slot. Thus, the portions 23 and 25 do not need to interfere vertically because they have interference laterally beyond the sides of the slot when installed. However, they may be slid down for vertical interference as well where the slots are dimensioned to accept it. Once both the upper finger 22 and the lower finger 24 are inserted in a slot 16, then the clip 20 can in some embodiments be moved downward so that at least portions 23 and 25 slide behind the pilaster 12 and further hold the clip 20 in place.

Removal of the clip 20 is by substantially the reverse steps employed to install it. The user can, either manually or with the assistance of a tool inserted into the cut out 40, twist and pop the lower leg 24 out from engagement in the slot 16. Then the clip 20 can be slid upwards (if necessary) so that the upper finger 22 clears the slot 16, and the clip 20 can be conveniently removed from the slot 16.

The pilaster strip 12 in this system can be identical or similar to conventional pilaster strips. This provides a significant advantage of the invention, whereby clips 20 according to the invention can be used to retrofit existing systems, or can be used in new systems without the need for redesign of the pilaster strip. Another advantage of the invention is that the retaining feature is accomplished solely by the clips and the pilasters themselves, and there is no need for additional screws, plugs, spring polers or other additional items or structure to accomplish the retaining of the clips. The slots can also be integrated with the cabinet wall itself, instead of part of a separate strip element.

Another benefit of the invention is that clips according to the invention are simple and economical to manufacture. For example, a flat planar clip can be formed, for example by punching, from metal sheet material, in a fashion similar or identical to conventional clip manufacture. Once the flat clip has been formed, the fingers are bent to have the twist applied to them, which can be accomplished by relatively uncomplicated hand tools and/or power-assisted tools. More complicated molding or forming processes are not required, although in some embodiments they may be suitable.

FIG. 6 in particular shows that the entire upper finger 22 is angled relative to the body 21, and the lower portion 25 of lower finger 24 is angled in an opposite direction. However, either part or all of either or both fingers 22 and 24 may be bent.

The specific example treated primarily in this description is that of a shelf-supporting clip, used with a vertical pilaster strip on the inside wall of a cabinet such as a refrigerator or other environmental unit. However, it will be appreciated that the invention is applicable to other cabinets, and indeed other pilaster strip applications. Further, the pilaster strip does not need to be vertical, and may be angled at some other orientation.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A mounting system, comprising:

an elongated pilaster having at least a pair of slots therein, said pilaster elongated in a first direction of elongation in vertical axis; and a clip, the clip comprising:

a body portion having a first planar portion having a first axis therethrough, said body portion having a first edge;

a first finger portion projecting from said first edge of said first planar portion of said body portion and insertable through one of the slots, said first finger having a second planar portion having a second axis therethrough; and a second finger portion projecting from said first edge of said first planar portion of said body portion and insertable in another of the slots, said second finger having a third planar portion at an opposite angle to said second planar portion so that said second and third planar portions are non-coplanar with each other, said third planar portion having a third axis therethrough wherein the second axis and the third axis intersect, wherein the plane of said first planar portion is parallel with the first direction of elongation of said pilaster and intersects with a portion of the pilaster when the clip is installed on the pilaster.

2. A clip according to claim 1, wherein said body portion is substantially planar and is non-coplanar with said second and third planar portions.

3. A clip according to claim 1, wherein the clip is formed from a resilient material.

4. A clip according to claim 1, wherein the clip is formed from bent sheet material.

5. A clip according to claim 3, wherein the sheet material is steel.

6. A clip according to claim 1, wherein the clip is formed form a sheet material, and said body portion is generally planar in a first plane, said first planar portion is in a second plane, and said second planar portion is in a third plane, wherein each of the planes are at angles to one another.

7. A clip according to claim 6, wherein the sheet material is steel.

8. A system for supporting an item on a wall surface, comprising:

an elongated pilaster strip adapted to be arranged generally along the wall surface and having at least two slots therein, said pilaster elongated in a first direction of elongation in vertical axis; and a clip having:

a body portion having a first planar portion having a first axis therethrough, said body portion having a first edge;

a first finger portion projecting from said first edge of said first planar portion of said body portion and insertable through one of the slots, said first finger having a second planar portion having a second axis therethrough; and a second finger portion projecting from said first edge of said first planar portion of said body portion and insertable in another of the slots, said second finger having a third planar portion at an opposite angle to said second planar portion so that said second and third planar portions are non-coplanar with each other, said third planar portion having a third axis therethrough wherein the second axis and the third axis intersect, wherein the plane of said first planar portion is parallel with the first direction of elongation of said pilaster and intersects with a portion of the pilaster when the clip is installed on the pilaster.

9. A clip according to claim 8, wherein said body portion is substantially planar and is non-coplanar with said second and third planar portions.

10. A clip according to claim 8, wherein the clip is formed from a resilient material.

11. A clip according to claim 8, wherein the clip is formed from bent sheet material.

12. A clip according to claim 11, wherein the sheet material is steel.

13. A clip according to claim 8, wherein the clip is formed from a sheet material, and said body portion is generally planar in first plane, said first planar portion is in a second plane, and said second planar portion is in a third plane, wherein each of the planes are at angles to one another.

14. A clip according to claim 13, wherein the sheet material is steel.

15. A method for releasably affixing a clip to a pilaster strip, comprising the steps of:

providing an elongated pilaster strip having at least two slots therein, the pilaster elongated in a first direction of elongation in vertical axis;

providing a clip comprising a body portion having a first planar portion having a first axis therethrough and the body portion having a first edge, a first finger portion projecting from said first edge of said first planar portion of said body portion and insertable through one of the slots, said first finger having a second planar portion having a second axis therethrough, and a second finger portion projecting from said first edge of said first planar portion of said body portion and insertable in another of the slots, said second finger having a third planar portion at an opposite angle to said second planar portion so that said second and third planar portions are non-coplanar with each other said third planar portion having a third axis therethrough, inserting the first finger of the clip into a slot of the strip, so that the first finger extends into the slot, and a second finger is offset from a second slot;

releasing the force applied to the clip, so that the clip springs into a position where the second finger has a partial interference with a second slot and the first finger has a partial interference with the first slot, thereby retaining the clip in the slot such that the second axis intersects the third axis, wherein the plane of said first planar portion is parallel with the first direction of elongation of said pilaster and intersects with a portion of the pilaster when the clip is installed on the pilaster.

16. The method of claim 15, further comprising the step of removing the clip from the pilaster strip by applying a force to flex the clip.

17. The method according to claim 16, wherein the step of removing the clip comprises the steps of:

applying a force to the clip to flex the clip so that the second finger does not interfere with the slot and is able to be removed from the second slot; and removing the second finger from the second slot.

18. A mounting system comprising:

an elongated pilaster having at least a pair of slots therein, said pilaster elongated in a first direction of elongation in vertical axis; and a clip comprising:

a body portion having a first planar portion having a first axis therethrough, said body portion having a first edge;

first engaging means projecting from said first edge of said first planar portion of said body portion for engaging one of the slots and having a second planar portion having a second axis therethrough; and second engaging means projecting from said first edge of said first planar portion of said body portion for engaging the other slots and having a third planar portion at an opposite angle to said second planar portion so that said second and third planar portions are non-coplanar with each other said third planar portion having a third axis therethrough wherein the second axis and the third axis intersect, wherein the plane of said first planar portion is parallel with the first direction of elongation of said pilaster and intersects with a portion of the pilaster when the clip is installed on the pilaster.

* * * * *